US005098546A

United States Patent [19]

Kawashima et al.

[11] Patent Number: 5,098,546

[45] Date of Patent: Mar. 24, 1992

[54] OXYGEN-GENERATING ELECTRODE

[75] Inventors: Yukio Kawashima, Tokyo; Kazuhide Ohe, Kamagoya; Hiroyuki Nakada, Tokyo, all of Japan

[73] Assignee: TDK Corporation, Tokyo, Japan

[21] Appl. No.: 626,997

[22] Filed: Dec. 13, 1990

[30] Foreign Application Priority Data

Dec. 22, 1989 [JP] Japan ..... 1-331376

[51] Int. Cl.[5] ..... C25B 11/06; C25B 11/10

[52] U.S. Cl. ..... 204/290 R; 204/290 F; 428/472

[58] Field of Search ..... 204/290 R, 290 F; 428/472, 693, 901

[56] References Cited

U.S. PATENT DOCUMENTS 3,846,273 11/1974 Bianchi et al. ..... 428/472 X
3,878,083 4/1975 DeNora et al. ..... 204/290 F
3,926,751 12/1975 DeNora et al. ..... 204/290 F X
4,072,585 2/1978 Bianchi et al. ..... 204/98
4,797,182 1/1989 Beer et al. ..... 204/290 F X

*Primary Examiner*—Donald R. Valentine
*Attorney, Agent, or Firm*—Wyatt, Gerber, Burke and Badie

[57] ABSTRACT

Proposal is made for providing a high-performance electrode suitable for use in an oxygen-generating electrolytic process having an outstandingly low oxygen overvoltage and exhibiting high durability in a prolonged run of electrolysis. The electrode consists of an electroconductive substrate of a metal, e.g., titanium, and a multiple composite oxide coating layer thereon consisting of at least one layer of type A composed of iridium oxide and tantalum oxide in an Ir:Ta molar ratio of 40:60 to 79.9:20.1 and at least one layer of type B formed on the type A layer composed of iridium oxide and tantalum oxide in an Ir:Ta molar ratio of 80:20 to 99.9:0.1. A plural number of type A layers and a plural number of type B layers can be alternately laid one on the other so as to improve the mechanical stability of the coating layer on the substrate surface.

5 Claims, No Drawings

OXYGEN-GENERATING ELECTRODE

BACKGROUND OF THE INVENTION

The present invention relates to a novel oxygen-generating electrode and a method for the preparation thereof. More particularly, the invention relates to an electrode having excellent durability and low oxygen overvoltage for generating oxygen by electrolytically oxidizing an aqueous solution on an anode as well as to a method for the preparation thereof.

A type of conventional metallic electrodes widely used in the electrolytic industry includes those prepared by providing an overcoating layer of a platinum group metal or an oxide thereof on an electroconductive substrate made from titanium metal.

For example, known electrodes used as the anode for producing chlorine by the electrolysis of brine include those prepared by providing a titanium substrate with an overcoating layer formed of an oxide mixture of ruthenium and titanium or an oxide mixture of ruthenium and tin (see, for example, Japanese Patent Publications 46-21884, 48-3954 and 50-11330).

Besides the above mentioned process of electrolysis of brine in which chlorine is produced as the electrolytic product. various processes are known in the electrolytic industry in which oxygen is generated on the electrode. Examples of such an oxygen-generating electrolytic process include recovery of spent acids, alkalis or salts, electrolytic metallurgy of copper, zinc, etc., metal plating, cathodic protection and the like.

These oxygen-generating electrolytic processes require electrodes quite different from the electrodes successfully used in the electrolytic processes accompanied by generation of chlorine. When an electrode for the chlorine-generating electrolysis, such as the above mentioned titanium-based electrode having a coating layer of an oxide mixture of ruthenium and titanium or ruthenium and tin, is used in an oxygen-generating electrolytic process, the electrolysis must be discontinued before long due to rapid corrosion of the electrode. Namely, the electrodes must be specialized for the particular electrolytic processes. The electrodes most widely used in an oxygen-generating electrolysis are lead-based electrodes and soluble zinc anodes although other known and usable electrodes include iridium oxide- and platinum-based electrodes, iridium oxide- and tin oxide-based electrodes, platinum-plated titanium electrodes and the like.

These conventional electrodes are not always quite satisfactory due to the troubles which may be caused depending on the type of the oxygen-generating electrolytic process. When a soluble zinc anode is used in zinc plating, for example, the anode is consumed so rapidly that adjustment of the electrode distance must be performed frequently. When a lead-based insoluble electrode is used for the same purpose, a small amount of lead in the electrode is dissolved in the electrolyte solution to affect the quality of the plating layer. Platinum-plated titanium electrodes are also subject to rapid consumption when used in a process of a so-called high-speed zinc plating process at a high current density of 100 $A/dm^2$ or higher.

Accordingly, it is an important technical problem in the technology of electrode manufacture to develop an electrode useful in an oxygen-generating electrolytic process which can be used with versatility in various processes without the above mentioned drawbacks.

When an oxygen-generating electrolytic process is performed by using a titanium-based electrode having a coating layer thereon, on the other hand, it is not rare or rather usual that an intermediate layer of titanium oxide is formed between the substrate surface and the coating layer to cause a gradual increase in the anode potential or eventually to cause falling of the coating layer with the substrate surface being in a passive state. Various attempts and proposals have been made to provide an appropriate intermediate layer beforehand between the substrate surface and the coating layer in order to prevent subsequent formation of a layer of titanium oxide (see for example, Japanese Patent Publications 60-21232 and 60-22074 and Japanese Patent Kokai 57-116786 and 60-184690).

The electrode having an intermediate layer provided as mentioned above is not so effective as desired when the electrode is used in an electrolytic process at a high current density because the electroconductivity of such an intermediate layer is usually lower than the overcoating layer.

It is also proposed to provide an intermediate layer formed by dispersing platinum in a matrix of a non-precious metal oxide (see Japanese Patent Kokai 60-184691) or to Provide an intermediate layer formed of an oxide of a valve metal, e.g., titanium, zirconium, tantalum and niobium, and a precious metal (see Japanese Patent Kokai 57-73193). These electrodes are also not quite advantageous because platinum has no very high corrosion resistance in itself in the former type and, in the latter type, the kind of the valve metal oxide and the compounding amount thereof are not without inherent limitations.

Besides, Japanese Patent Kokai 56-123388 and 56-123389 disclose an electrode having an undercoating layer containing iridium oxide and tantalum oxide on an electroconductive metal substrate and an overcoating layer of lead dioxide. The undercoating layer in this electrode, however, serves to merely improve the adhesion between the substrate surface and the overcoating layer of lead dioxide to exhibit some effectiveness to prevent corrosion due to pinholes. When such an electrode is used in an oxygen-generating electrolytic process, disadvantages are caused because of the insufficient effect of preventing formation of titanium oxide and unavoidable contamination of the electrolyte solution with lead.

The inventors have previously proposed an improved oxygen-generating electrode of which the electroconductive substrate of, for example, titanium metal is provided with an undercoating layer compositely consisting of iridium oxide and tantalum oxide in a specific molar proportion and an overcoating layer of iridium oxide formed thereon (see, Japanese Patent Kokai 63-235493). The electrode of this type having a bilayered coating, however, is not quite satisfactory in respect of the oxygen overvoltage which cannot be low enough to be desirably 400 mV or lower although an improvement can be obtained in the durability of the electrode. Further, the inventors have proposed an electrode having a ternary composite coating layer of iridium oxide, tantalum oxide and platinum metal formed on an electroconductive substrate in a specific molar proportion (see Japanese Patent Kokai 1-301876). The performance of the electrode of this type is indeed superior to the above described electrode with a bilayered coating and satisfactory if it is not for the expensiveness of the platinum metal.

SUMMARY OF THE INVENTION

An object of the present invention is therefore to provide a novel and improved electrode suitable for use in an oxygen-generating electrolytic process which is free from the above described problems and disadvantages in the prior art electrodes. More particularly, the object of the present invention is to provide an electrode formed of an electroconductive substrate of a metal such as titanium and provided with a coating layer basically composed of iridium oxide and tantalum oxide.

The electrode of the present invention suitable for use in an oxygen-generating electrolytic process is an integral body consisting of:

(A) an electroconductive substrate made of a metal which is preferably titanium; and (B) a multiple coating layer on the surface of the substrate, the multiple coating layer consisting of at least one layer of a first type essentially having a composite oxide composition of from 40 to 79.9% or, preferably, from 50 to 75% by moles as metal of iridium oxide and from 60 to 20.1% or, preferably, from 50 to 25% by moles as metal of tantalum oxide and at least one layer of a second type essentially having a composite oxide composition of from 80 to 99.9% or, preferably, from 80 to 95% by moles as metal of iridium oxide and from 20 to 0.1% or, preferably, from 20 to 5% by moles as metal of tantalum oxide alternately laid one on the other with the proviso that the undermost layer in contact with the substrate surface is of the first type.

In addition to the advantages in the oxygen overvoltage and durability of the electrode obtained in the above defined electrode, an additional advantage is obtained in respect of the adhesion of the coating layer to the substrate surface when the multiple coating layer has at least two of the first type layers or each at least two of the first type layers and the second type layers.

DETAILED DESCRIPTION OF THE PREFERRED EMBODIMENTS

As is described above, the electrode of the invention has a basic structure that an electroconductive substrate of a metal such as titanium is provided with a multiple coating layer consisting of at least one layer of the first type and at least one layer of the second type each having a specified composite oxide composition different from the other consisting of iridium oxide and tantalum oxide and the first type layers and the second type layers are laid one on the other alternately with the proviso that the undermost layer in contact with the substrate surface is of the first type. Such a multiple layered structure of the coating layer is advantageous in the improved electrode performance for oxygen generation and the increased durability of the electrode as compared with a single coating layer formed from iridium and tantalum oxides which is disadvantageous in respect of the gradual increase in the oxygen overvoltage when electrolysis is continued resulting in a loss of electric power.

In the preparation of the inventive electrode, an electroconductive substrate is coated first with a coating solution for the undermost layer which is of the first type, referred to as the type A hereinafter, containing iridium and tantalum each in the form of a soluble compound followed by a heat treatment in an oxidizing atmosphere to effect thermal decomposition of the respective metal compounds into the form of an oxide composite of the metals composed of from 40 to 79.9% or, preferably, from 50 to 75% by moles as metal of iridium oxide and from 60 to 20.1% or, preferably, from 50 to 25% by moles as metal of tantalum oxide. The electrode body provided with the undermost coating layer of the type A is then coated with another coating solution containing iridium and tantalum each in the form of a soluble compound in a proportion for the second layer which :s of the second type, referred to as the type B hereinafter. followed by a heat treatment in an oxidizing atmosphere to effect thermal decomposition of the respective metal compounds into the form of an oxide composite of the metals composed of from 80 to 99.9% or, preferably, from 80 to 95% by moles as metal of iridium oxide and from 20 to 0.1% or, preferably, from 20 to 5% by moles as metal of tantalum oxide. The above described procedures of coating the surface with the coating solution for the type A or type B layer followed by baking to form a composite oxide layer can be repeated as many times as desired to form a multiple coating layer consisting of at least two of the type A layers and at least two of the type B layers alternately laid one on the other. The top layer of the multiple coating layer can be either of the type A or of the type B.

The metal making the electroconductive substrate of the inventive electrode is selected from valve metals such as titanium, tantalum, zirconium, niobium and the like. These metals can be used either singly or in the form of an alloy of two kinds or more according to need. Titanium is preferred.

The undermost layer of the multiple coating layer in contact with the substrate surface is of the type A of which the molar proportion of the iridium oxide and tantalum oxide is in the above specified range. Preferably, the molar proportion of iridium oxide should be relatively small within the range although an excessively large proportion of tantalum oxide may cause a disadvantageous increase in the oxygen overvoltage. The coating amount of this undermost layer of the first type composition should be in the range from 0.05 to 3.0 $mg/cm^2$ calculated as iridium metal.

The second layer provided on the above mentioned undermost layer to form the multiple coating layer is of the type B of which the molar proportion of iridium oxide and tantalum oxide is also in the above specified range. Preferably, the molar proportion of iridium oxide should be relatively large within the range although an excessively large proportion thereof may cause a disadvantage of a decrease in the adhesion of the coating layer. The coating amount of this second layer of the type B is preferably in the range from 0.01 to 7 $mg/cm^2$ calculated as iridium metal. When the coating amount thereof is too small, consumption of the electrode in the electrolytic process may be unduly increased to cause a decrease in the durability of the electrode.

Although the multiple coating layer basically is composed of a type A layer, which is the undermost layer, and a type B layer forming a bilayered structure, it is optional that the multiple coating layer consists of three or more of the layers in an alternate order of type A, type B, Type A, type B, and so on by repeating the coating and baking treatment. The topmost layer can be either of the type A or of the type B. Such a multiple alternate repetition of the type A and type 8 layers has an advantage of increasing the adhesive strength of the coating layer and decreasing the consumption of the electrode in the electrolytic process contributing to the improvement of the durability of the electrode.

The coating solution for forming the layers of the type A and type B is prepared by dissolving, in a suitable solvent compounds of iridium and tantalum each in a specified concentration. The metal compounds should be soluble in the solvent and decomposed at an elevated temperature of baking to form an oxide of the respective metals. Examples of the metal compounds include chloroiridic acid $H_2IrCl_6 \cdot 6H_2O$, iridium chloride IrCl, and the like as the source material of iridium oxide and tantalum halides, e.g., tantalum chloride $TaCl_5$, tantalum ethoxide and the like as the source material of tantalum oxide. The proportion of these two kinds of metal compounds should be selected depending on the desired molar proportion of the metal oxides produced by thermal decomposition of the compounds to form the layer and the proportion in the coating solution can be about the same as in the composite oxide layer formed therefrom although a possible loss of certain metal compounds by vaporization in the course of the baking treatment, which may amount to several % of the content in the coating solution depending on the conditions of baking, should be taken into account. The electrode body coated with the coating solution is dried and then subjected to a heat treatment for baking in an oxidizing atmosphere containing oxygen such as air. The baking treatment is performed for 1 to 60 minutes at a temperature in the range from 400 to 550 ° C so as to effect complete decomposition and oxidation of the metal compounds. The atmosphere for the baking treatment should be fully oxidizing because an incompletely oxidized coating layer may contain the iridium or tantalum metal in the free metallic state resulting in a decrease in the durability of the electrode. When a single coating followed by baking cannot give a layer having a desired thickness, the process should be repeated several times until the coating amount of the layer reaches a desired range. These procedures are basically the same for the type A coating layers and for the type B coating layers excepting that the formulation of the coating solutions should be different corresponding to the desired iridium-to-tantalum molar ratio ;n the layers of the composite oxide formed by the thermal decomposition.

When adequately prepared according to the above given disclosure, the electrode of the invention can be used as the anode in an oxygen-generating electrolysis exhibiting an outstandingly long life at a low cell voltage or a considerably improved life at a high current density of 100 A/dm$^2$ or larger with little increase in the oxygen overvoltage in a long run of a continued electrolytic process.

In the following, examples and comparative examples are given to illustrate the electrode of the invention and the method for the preparation thereof in more detail but not to limit the scope of the invention in any way. In each of the following examples and comparative examples, the electrode prepared was subjected to the evaluation tests for the oxygen overvoltage, increase of the oxygen overvoltage in the lapse of time in a continuous electrolysis and durability as well as for the mechanical stability of the coating layer in the procedures described below.

Oxygen overvoltage

The oxygen overvoltage was determined by the voltage scanning method at 30 C. in a 1 M aqueous solution of sulfuric acid at a current density of 20 A/dm$^2$.

Electrode durability

Electrolysis was conducted with the electrode as the anode and a platinum electrode as the cathode in a 1 M aqueous solution of sulfuric acid at 60° C. at a current density of 200 A/dm$^2$ on the anode until the electrolysis could no longer be continued due to an undue increase of the cell voltage, which was initially about 5 volts, to exceed 10 volts. The results are recorded in four ratings of: Excellent for the life of at least 3000 hours; Good for the life of 2000 to 3000 hours; Fair for the life of 1000 to 2000 hours; and Poor for the life of 1000 hours or shorter.

Increase of oxygen overvoltage in continued electrolysis

Electrolysis was conducted for 1000 hours under the same conditions as ;n the above described durability test and the electrode was subjected to the determination of the oxygen overvoltage to record the increase thereof from the initial value. The results were recorded in three ratings of: Good for an increase not exceeding 0.3 volt; Fair for an increase of 0.3 to 0.7 volt; and Poor for an increase of 0.7 volt or larger.

Mechanical stability of coating layer

Electrolysis by using the electrode was conducted for 1000 hours in the same manner as in the above described durability test and then the electrode as dried was subjected to an ultrasonic vibration test for 5 minutes to cause falling of the surface portion of the coating layer resulting in a decrease in the thickness of the layer. The decrease in the amount of iridium as metal per unit area of the coating layer was determined by the method of fluorescent X-ray analysis. The results were recorded in three ratings of Good, Fair and Poor when the decrease in the amount of iridium from the initial value was less than 5%, 5% to 10% and more than 10%, respectively.

Example 1

Experiments No. 1 to No. 12

Several coating solutions were prepared each by dissolving chloroiridic acid and tantalum ethoxide in n-butyl alcohol in different molar proportions. The concentration of these two metal compounds in the coating solutions was always 80 g/liter as a total of iridium and tantalum metals.

A titanium substrate after etching with an aqueous hot oxalic acid solution was brush-coated with one of the above prepared coating solutions of the formulation corresponding to the iridium:tantalum molar ratio in the composite oxide layer formed by baking as indicated in Table 1 below as the first type layer and then dried and baked in an electric furnace at 500 C. for 7 minutes under a flow of air to form a composite oxide layer This procedure of coating with the solution, drying and baking was repeated several times until the coating amount at least 0.2 mg/cm$^2$ in Experiments No. 1 to No. 5, No. 11 and No. 12 and at least 0.4 mg/cm$^2$ in Experiments No. 6 to No. 10 calculated as iridium metal.

In Experiments No. 1 to No. 5 undertaken for the invention, the thus formed oxide layer had a composition of iridium tantalum molar ratio in the range from 50:50 to 75:25 while, in Experiments No. 6 to No. 12 undertaken for comparative purpose, the iridium:tantalum molar ratio was varied in a wider range from 100:0 to 0:100 by omitting the tantalum compound or iridium compound in Experiments No. 6 and No. 12, respectively.

The electrode bodies prepared in Experiments No. 6 to No. 10 provided with the single oxide layer of the first type formed ;n the above described manner were subjected as such to the evaluation tests while the electrode bodies prepared in Experiments No. 1 to No. 5, No. 11 and No. 12 were each provided with an overcoating composite oxide layer of iridium oxide and tantalum oxide of the second type by 7 times repetition of the coating, drying and baking treatment in the same manner as above excepting that the formulation of the coating solution was different as indicated in Table 1 from that used for the first type coating layer. The coating amount of the second coating layer was about 0.4 mg/cm$^2$ or larger calculated as iridium metal.

Table 1 summarizes the iridium:tantalum (Ir;Ta) molar ratios in the oxide composites forming the first and the second type coating layers in each Experiment as well as the results of the evalation tests for the initial value of the oxygen overvoltage, increase of the oxygen overvoltage in the continued electrolysis and durability of the electrode.

TABLE 1

| Experiment No. | First type coating layer Ir:Ta in molar ratio | Second type coating layer Ir:Ta in molar ratio | Oxygen overvoltage, mV | Increase of oxygen overvoltage in continued electrolysis | Electrode durability |
|---|---|---|---|---|---|
| 1 | 50:50 | 85:15 | 385 | Good | Excellent |
| 2 | 60:40 | 85:15 | 385 | Good | Excellent |
| 3 | 60:40 | 90:10 | 390 | Good | Excellent |
| 4 | 70:30 | 90:10 | 395 | Good | Excellent |
| 5 | 75:25 | 90:10 | 395 | Good | Excellent |
| 6 | 100:0 | | 430 | Fair | Fair |
| 7 | 70:30 | | 410 | Fair | Good |
| 8 | 60:40 | | 405 | Fair | Good |
| 9 | 50:50 | | 405 | Fair | Fair |
| 10 | 30:70 | | 450 | Poor | Poor |
| 11 | 30:70 | 60:40 | 430 | Fair | Fair |
| 12 | 100:0 | 70:30 | 420 | Fair | Fair |

EXAMPLE 2

Experiments No. 13 to No. 22

The same titanium-made electrode substrate as used in Example 1 was provided in each of the Experiments with a multiple coating layer composed of at least two and up to seven coating layers of the type A and type B alternately laid one on the other. Table 2 below gives the iridum:tantalum molar ratios in the respective oxide composites forming the type A and type B layers in each Experiment. Table 2 also gives the total number of the type A and type 8 coating layers on the electrode in each of the Experiments. When the total number of the layers is an odd number, the topmost layer was of the type A and, when the total number of the layers is an even number, the topmost layer was of the type 8 as a matter of course since the undermost layer was always of the type A.

The results of the evaluation tests undertaken with these electrodes are shown in Table 2.

TABLE 2

| Experiment No. | Type A coating layer Ir:Ta in molar ratio | Type B coating layer Ir:Ta in molar ratio | Total number of type A and type B coating layers | Oxygen overvoltage, mV | Increase of oxygen overvoltage in continued electrolysis | Electrode durability | Mechanical stability of coating layer |
|---|---|---|---|---|---|---|---|
| 13 | 60:40 | 85:15 | 3 | 385 | Good | Excellent | Good |
| 14 | 60:40 | 85:15 | 4 | 390 | Good | Excellent | Good |
| 15 | 60:40 | 85:15 | 4 | 385 | Good | Excellent | Good |
| 16 | 60:40 | 85:15 | 7 | 385 | Good | Excellent | Good |
| 17 | 50:50 | 85:15 | 4 | 385 | Good | Excellent | Good |
| 18 | 70:30 | 90:10 | 4 | 390 | Good | Excellent | Good |
| 19 | 75:25 | 90:10 | 4 | 395 | Good | Excellent | Good |
| 20 | 75:25 | 90:10 | 2 | 395 | Good | Excellent | Fair |
| 21 | 30:70 | 60:40 | 4 | 430 | Fair | Fair | Good |
| 22 | 70:30 | 100:0 | 2 | 430 | Good | Excellent | Fair |

What is claimed is:

1. An electrode for use in an oxygen-generating electrolytic process which is an integral body comprising:

(A) an electroconductive substrate made from a metal; and (B) a multiple coating layer on the surface of the substrate, the multiple coating layer consisting of at least one layer of a first type essentially having a composite oxide composition of from 40 to 79.9% by moles as metal of iridium oxide and from 60 to 20.1% by moles as metal of tantalum oxide and at least one layer of a second type essentially having a composite oxide composition of from 80 to 99.9% by moles as metal of iridium oxide and from 20 to 0.1% by moles as metal of tantalum oxide alternately laid one on the other with the proviso that the undermost layer in contact with the substrate surface is of the first type.

2. The electrode for use in an oxygen-generating electrolytic process as claimed in claim 1 in which the multiple coating layer on the substrate surface consists of at least two layers of the first type and at least one layer of the second type.

3. The electrode for use in an oxygen-generating electrolytic process as claimed in claim 1 in which the layer of the first type has a composite oxide composition of from 50 to 75% by moles as metal of iridium oxide and from 40 to 25% by moles as metal of tantalum oxide and the layer of the second type essentially has a composite oxide composition of from 80 to 95% by moles as metal of iridium oxide and from 20 to 5% by moles as metal of tantalum oxide.

4. The electrode for use in an oxygen-generating electrolytic process as claimed in claim 1 in which the metal making the electroconductive substrate is titanium.

5. The electrode for use inn an oxygen-generating electrolytic process as claimed in claim 1 inn which the coating amount of each of the first type layers and the second type layers is in the range from 0.01 to 5 $mg/cm^2$ calculated as iridium metal.

* * * * *